United States Patent [19]

Chappell et al.

[11] Patent Number: 4,656,397

[45] Date of Patent: Apr. 7, 1987

[54] METHOD AND APPARATUS FOR CONTROLLING FLASH TUBE DISCHARGE

[75] Inventors: George D. Chappell; Jerry B. West, both of DeSoto; Robert B. Wilson, Ovilla, all of Tex.

[73] Assignee: Simplec Manufacturing Company, Inc., Dallas, Tex.

[21] Appl. No.: 708,009

[22] Filed: Mar. 4, 1985

[51] Int. Cl.[4] ..... H05B 37/00

[52] U.S. Cl. ..... 315/241 S; 315/151; 315/158; 315/241 R; 315/307

[58] Field of Search ..... 315/241 R, 241 S, 151, 315/158, 307

[56] References Cited

U.S. PATENT DOCUMENTS

| | | | |
|---|---|---|---|
| 4,005,337 | 1/1977 | Rabe | 315/241 S |
| 4,369,394 | 1/1983 | Vincent | 315/241 S |
| 4,477,796 | 10/1984 | Kearsley | 315/241 S |

*Primary Examiner*—Harold Dixon

*Attorney, Agent, or Firm*—Richards, Harris, Medlock & Andrews

[57] ABSTRACT

A strobe light firing circuit is provided with an integrated circuit (10) for deriving both timing and power generating pulses. A field-effect power transistor (16) gates the power generation transients while effectively isolating the timing integrated circuit (10) from high transients during the switching of the transistor (16). Timing pulses from the timing circuit (10) are divided in frequency by a binary counter (38) and then sequentially applied at the output pins of a decade counter (40) for strobe timing sequence selection. A strobe light firing pulse is differentiated (48) to form a pulse for shutting off power generation pulses from time (10) for a time effective for the flash tube (58) to recover for a subsequent discharge.

32 Claims, 2 Drawing Figures

METHOD AND APPARATUS FOR CONTROLLING FLASH TUBE DISCHARGE

TECHNICAL FIELD

This invention relates to method and apparatus for a strobed light output, and, more particularly, to method and apparatus for generating electrical power and timing signals for operating a high intensity strobe flash tube.

BACKGROUND OF THE INVENTION

High intensity bursts of light, commonly referred to as strobe lighting, are useful in a variety of applications. Flashes of high intensity light may be delivered at regular intervals to create special effects for photography or to "freeze" the motion of an object where the lamp discharge frequency is synchronized with the movement. Further, the intensity of the output light from a flash tube is visible in daylight ambient conditions and may be used in both daytime and nighttime lighting to serve as a warning signal or a position marker.

By way of example, tall structures such as broadcast antennas are provided with strobe lights to warn aircraft. Likewise, aircraft use strobe lighting to identify their position to other aircraft in their vicinity. Rapidly firing strobe lights are used on emergency vehicles to direct attention to the moving vehicle and to warn traffic ahead of the vehicle.

Conventional circuits for use with a flash tube are generally analog-type devices. The high voltage necessary to produce an intense light flash is commonly generated from a blocking oscillator circuit using a bipolar power transistor. The output waveform from the blocking oscillator circuit is applied across the primary windings of a transformer. The oscillating current in the primary windings may then be varied rapidly enough to induce a high voltage in the secondary windings of the transformer according to well established principles. The high voltage generated across the secondary windings, in turn, produces a current which is stored in high voltage capacitors. The voltage across the storage capacitors will increase as current is cyclically delivered to these capacitors.

A timing circuit must also be provided in order to deliver the energy stored in the high voltage capacitors to the flash tube. Conventionally, independent circuitry is provided for generating the timing signals. An integrated circuit may be configured as an oscillator with reference timing determined by a connected resistor-capacitor (RC) circuit.

The output from the timing circuit is applied to the control lead of an SCR to connect the circuit containing the storage capacitors to the flash tube. The stored energy is used by the flash tube to generate the high intensity light output from the system.

In conventional strobe light circuitry, high voltage transients may be induced across various circuit elements because of the voltages induced in transformer windings from rapidly changing current conditions. Such high voltage transients may severely damage circuit components.

Further, conventional circuitry may permit solid state devices to waste large amounts of the input energy in the form of heat. While heat sinks can be provided to assist in dissipating the heat, the resulting high temperatures may severely shorten the life span of the device. Also, heat generation is an inefficient use of input power, which may be stored energy from a finite source.

In addition, conventional flash tubes may often be used with conventional circuits for only a short time. As flash tubes age they frequently require additional recovery time before the tube may be discharged again. The recovery may be impeded, or even stopped, by the application of electrical signals to the tube during the recovery which would otherwise be insufficient to discharge the tube.

Conventional strobe tube circuits also generally fail to automatically accommodate changes in ambient light conditions in any way. The same light intensity may be delivered during full daylight as during nighttime. In one variation, a switch is provided to enable an operator to manually select a higher intensity output for daylight strobe visibility.

These and other disadvantages of the prior art are overcome by the present invention and improved methods and circuitry are provided for generating power and control pulses for use in flash tube activation generating high intensity strobe light pulses.

SUMMARY OF THE INVENTION

A strobe light firing circuit is provided with an integrated circuit which generates a first output pulse train having a modulated pulse width effective to controllably generate the power delivered at a high voltage for application to a flash tube. A second output pulse train is also generated at the same pulse intervals as the first pulse train. The second pulse train is used for deriving a control pulse effective to fire the flash tube. A transformer is provided for the high voltage circuit with a primary winding for receiving an input current and a secondary winding having an output voltage related to the rate of change of said current in the primary winding. A field effect transistor (FET) is connected to the primary winding for receiving a control signal from the first pulse train for rapidly reducing the current in the primary winding.

Capacitors are connected across the transformer secondary windings for use in storing the energy delivered during transients produced in the secondary windings by the rapid current reduction in the primary windings. The voltage across the storage capacitors increases until the desired firing voltage is reached.

The second pulse train is provided to an integrated circuit counter which provides output pulses at intervals substantially greater than pulse intervals in the second pulse train. Output from the integrated circuit counter may be obtained at preselected intervals for delivery to a control circuit which delivers the energy stored in the storage capacitors to trigger the flash tube for delivering the high intensity strobe light.

Many additional features and advantages of the present invention will become apparent from the following detailed description, wherein reference is made to the figures in the accompanying drawings.

DETAILED DESCRIPTION OF THE PREFERRED EMBODIMENT

Figure 1:
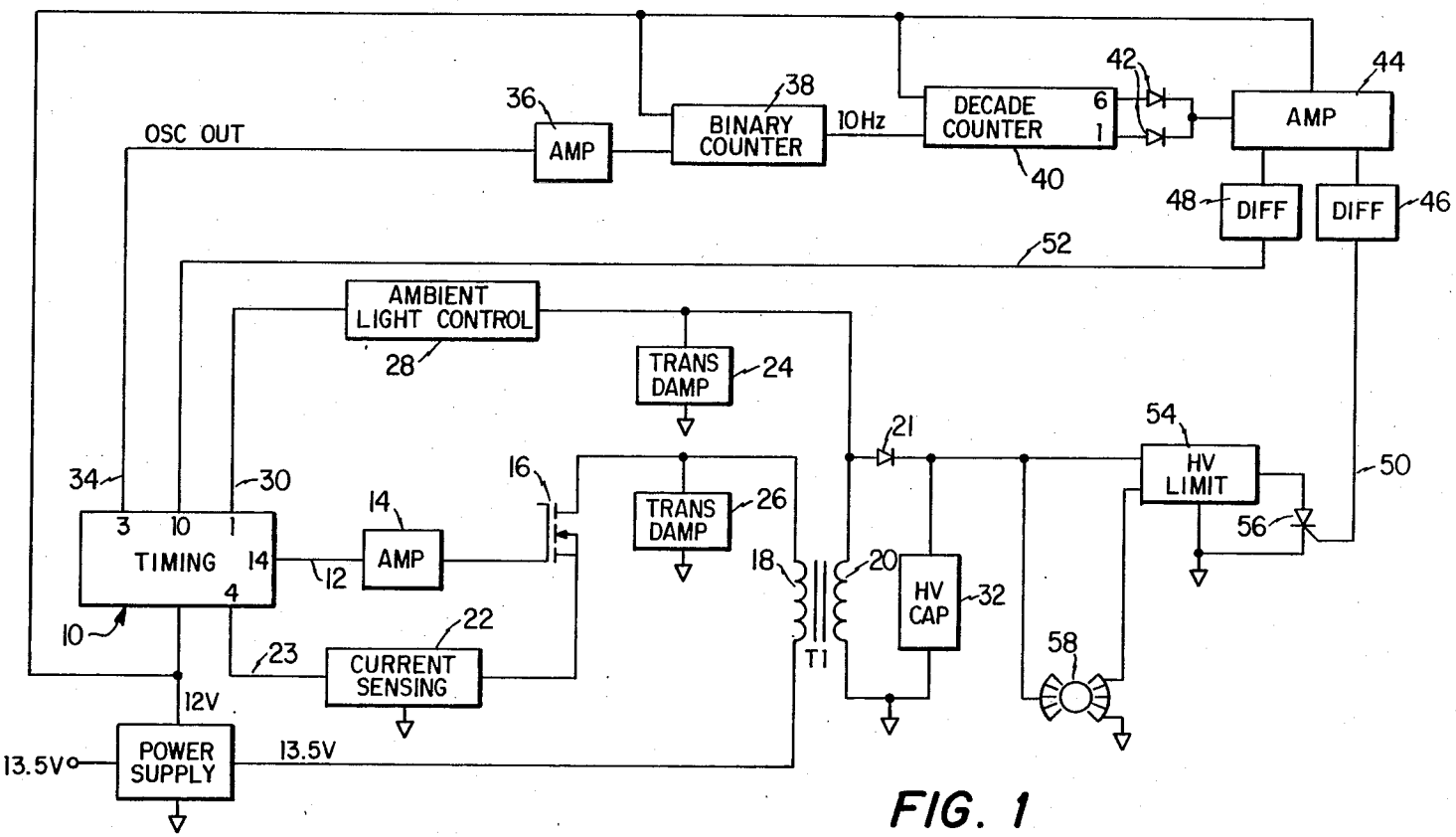
FIG. 1 is a block diagram of one embodiment of the strobe light firing circuit.

Referring first to FIG. 1, one embodiment of the present invention is shown in functional block diagram form. Integrated circuit 10 is provided for both high voltage generation and flash tube timing. A conventional clock pulse train is delivered on output line 34 for generating strobe timing signals. A second output pulse train is delivered on line 12 with pulses modulated in both amplitude and in width. The modulated output pulses are applied to the gate of a power field effect transistor (FET) 16 to drive a high voltage transformer T1 in the power supply circuit.

FET 16 is the primary switch used to control the power delivered by secondary winding 20 of transformer T1 to a high voltage capacitor storage system 32. The switch time obtained by FET 16 substantially increases the voltage generated during current switching over switching by conventional blocking oscillator circuits. FET 16 also effectively isolates integrated circuit 10 and other components supplying the gate control signals to FET 16 from transient voltages induced in windings 18 and 20 of transformer T1 during current switching operations.

Following the discharge of energy from capacitor storage system 32, the system will attempt to deliver high currents in primary winding 18 of transformer T1. If permitted to occur, high currents would saturate transformer T1, reducing the efficiency of energy transferred between primary winding 18 and secondary winding 20. Further, high currents would produce internal heating through the resistive components of circuit elements. Current sensing circuit 22 is provided to generate a control signal at intergrated circuit 10 which modulates the pulse width on line 12 to control the on-off cycle of FET 16 and prevent current surges, keeping the current in primary windings 18 within acceptable limits and generally constant.

The power control system embodiment depicted in FIG. 1 permits the system to operate over the wide range of transients induced in windings 18 and 20 as capacitor storage system 32 charges toward the desired high voltage condition. Transient damper 26 is provided across primary winding 18 to limit induced transient feedback to FET 16 and other primary circuit components. Transient damper 24 is likewise provided across secondary winding 20 to dissipate transient power of polarity which could not be delivered to capacitor storage 32. Damper circuits 24 and 26 act as "snubber circuits" to dissipate power which would otherwise be delivered to integrated circuits.

Integrated circuit 10 delivers timing signals on output line 34 to determine the relative timing of strobe flashes from flash tube 58. The clock signal on output line 34 may be provided to amplifier 36 for amplification and wave shaping and to binary counter 38 for increasing the interval between pulses (or decreasing the pulse rate) to a desired value. Output pulses from a first counter 38 are provided to a second counter 40. In one embodiment, first counter 38 is a binary-type counter and second counter 40 is a decade-type counter. Counter 40 may sequentially provide output states corresponding to a selected tuning sequence. A decade counter 40 may act to couple the input from the binary counter to ten output pins. One or more of the output pins may then be selected to obtain the desired timing period in sequence for single or multiple flash configurations.

As shown in FIG. 1, diodes 42 form a logic OR circuit for selecting the desired output signals. The output signal from decade counter 40 is provided to an amplifier 44 for wave shaping. Differentiation circuit 46 acts on the square wave output from amplifier 44 to deliver a well defined trigger signal to a firing gate, such as SCR 56, along trigger signal line 50.

The trigger signal on line 50 of SCR 56 enables the high voltage circuit to be completed for delivering energy stored in capacitor storage system 32 to flash tube 58. High voltage limit system 54 controls the energy supplied to flash tube 58 to establish and then extinguish the discharge within flash tube 58.

Flash tube 58 conventionally requires a recovery time before a subsequent flash can be obtained. This is particularly true as the flash tube ages. As shown in FIG. 1, differentiation circuit 48 provides a well defined signal on line 52 to integrated circuit 10 at a terminal appropriate to terminate the modulated pulse output along signal line 12 and assure that energy is not delivered to the flash tube 58 for any reason during the recovery time. This assured recovery time permits flash tubes to be used for a longer time than with conventional circuits.

The light intensity delivered by flash tube 58 is a function of the maximum voltage applied to flash tube 58 by capacitor storage system 32. This voltage is, in turn, a function of the magnitude of the transient voltage delivered across transformer T1. It would be desirable to provide a variable light intensity that provides a full light intensity in daylight, but a reduced light intensity in a darkened environment. Circuit 28 includes a light sensitive device to effect feedback to integrated circuit 10 along signal line 30 to provide feedback affecting output light intensity as a function of ambient light intensity. Ambient light control circuit 28 provides an output voltage signal on line 30 at input pin 1 of timing circuit 10. The input at pin 1 affects the width of output pulses on signal line 12 to affect strobe power delivery as hereinafter discussed.

Figure 2:
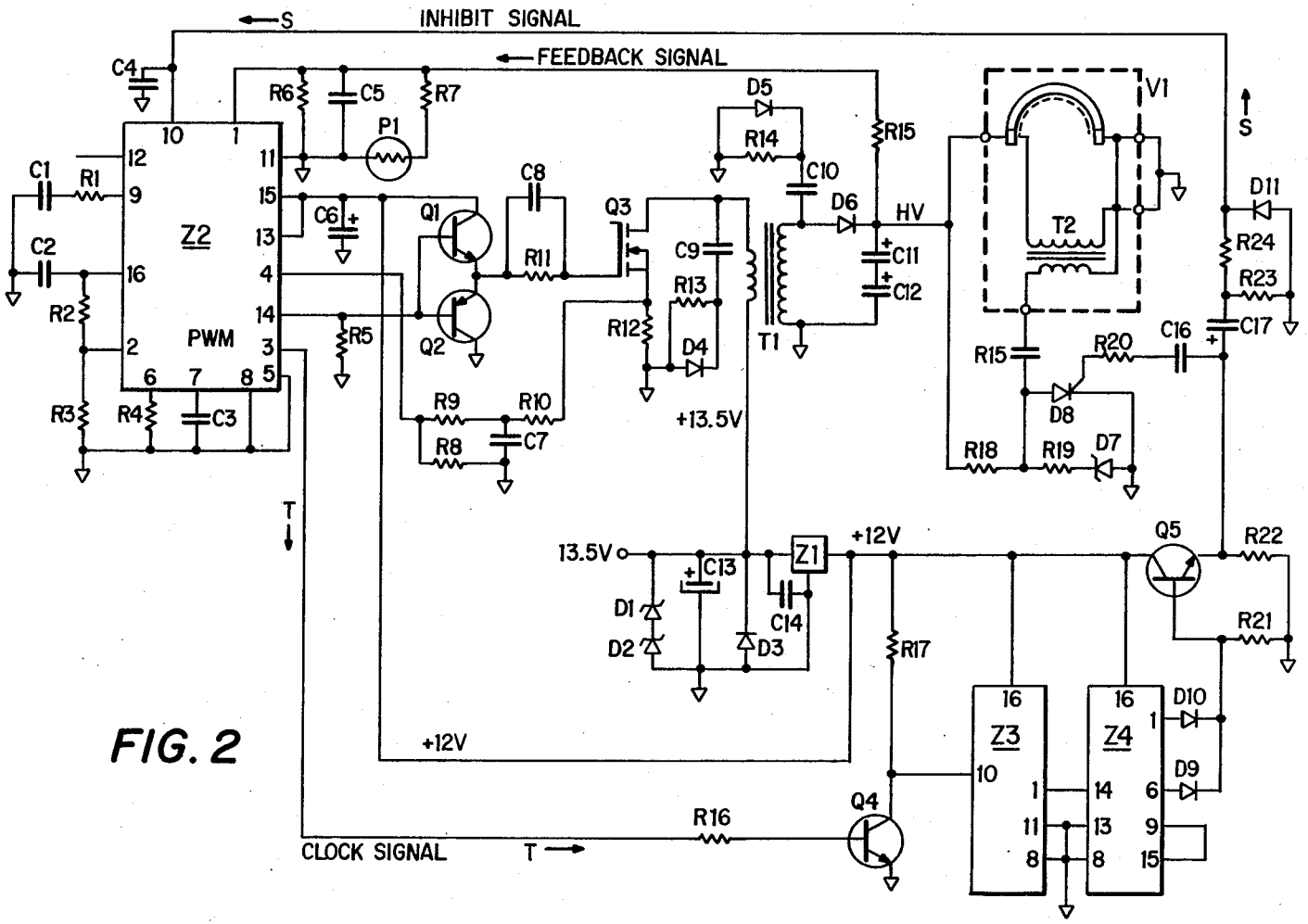
FIG. 2 is a schematic diagram of circuitry for generating and controlling energy at high voltage for use in generating high intensity light.

FIG. 2 more particularly depicts a circuit configuration for obtaining the functional outputs discussed for FIG. 1. Referring to FIG. 2, regulating pulse width modulator integrated circuit Z2 (which corresponds to integrated circuit 10 of FIG. 1) provides the primary timing pulses for strobe lighting and the driving signals for the power circuit. The frequency of clock pulses T at output pin 3 and the interval between the power driving signals at output pin 14 are determined by RC timing circuit R4 and C3. In a preferred embodiment, a primary timing frequency of about 20,500 Hz is obtained for the pulses delivered to output pins 3 and 14.

The driving signals for power generation at pin 14 are provided to the base of transistors Q1 and Q2 forming a square wave amplifier. Resistor R5 serves as a pull down element to reduce fall time for the square waves. Capacitor C6 supplies energy to the square wave through transistors Q1 and Q2. Capacitor C8 provides for delivery of the leading edge of the square wave pulse to the base of FET Q3. Resistor R11 limits the current delivered to Q3 during the square wave pulse.

When the control signal supplied by integrated circuit Z2 to the gate of FET Q3 puts FET Q3 in a conducting state, current through the primary winding of transformer T1 begins to increase, storing energy as a magnetic field within transformer T1. As is well known, this energy is delivered to the secondary winding of transformer T1 as a function of the rate of change of current through the primary winding of transformer T1. Thus, when the signal applied to the gate of FET Q3 places FET Q3 in a nonconductive state a high voltage is induced across the secondary windings of transformer T1 and the energy stored in the magnetic field is delivered through the secondary windings. Secondary current flows through diode D6 as the magnetic field is dissipating, providing energy to charge capacitors C11 and C12. The voltage across capacitors C11 and C12 after the transient is a function of the total charge delivered by current flow to capacitors C11 and C12. Additional charge is delivered during each transient and the voltage across capacitors C11 and C12 increases toward the peak transient voltage.

A feedback circuit from the cathode of diode D6 through resistor R15 is provided to regulate the high voltage across capacitors C11 and C12. Resistors R15 and R6 form a voltage divider to provide an error voltage at pin 1 of integrated circuit Z2. A pin 1 error voltage is compared with a reference error voltage developed at pin 2 of integrated circuit Z2 through resistors R2 and R3. The duration of the pulse appearing on pin 14 of integrated circuit Z2 is a function of the difference between the error voltage delivered to pin 1 and the reference error voltage at pin 2. As this difference decreases, the duration of the pulse appearing at pin 14 decreases to maintain a preselected high voltage across capacitors C11 and C12. In a preferred embodiment, a high voltage of 430 volts is reached and maintained.

When the energy stored in capacitors C11 and C12 has been discharged to a flash tube and a new recharging cycle has begun, a large current may be induced in the secondary winding of transformer T1 with a corresponding large current in the primary winding. The efficiency of transformer T1 would be reduced if the primary winding current is greater than the saturation current for transformer T1. Further, a large primary current may produce detrimental internal heating of FET Q3.

In the circuit depicted in FIG. 2, the current flowing in the primary winding of T1 produces a voltage across resistor R12 which is detected by circuit R8, R9, R10, and C7 to produce an input to integrated circuit Z2 at pin 4 to also control the duration of the output pulse on pin 14. The pulse width control signal derived by R8, R9, R10 and C7 acts to slowly increase the pulse width at the beginning of a charging cycle and maintain a controlled current in the primary winding of transformer T1 as capacitors C11 and C12 store energy.

A negative voltage transient may also be produced across the primary winding of transformer T1 as the current in the secondary winding decreases. This transient is attenuated by network C9, D4 and R13 which shunts the transient across FET Q3. This network also serves to decrease the voltage at the drain of FET Q3 when the gate signal at FET Q3 terminates the conventional current flow through the primary winding. Thus, the energy which would normally be dissipated by FET Q3 in the form of internal heating is shunted about FET Q3.

Depending on the breakdown voltage capability of a selected FET Q3, additional circuit components may be required to suppress high transient voltages across FET Q3. For example, an inductance element in the source line of FET Q3 could be provided for transient suppression.

Likewise, the decrease of current in the secondary winding of transformer T1 can produce a self-induced transient in the secondary winding. The self-induced transient is dissipated through the circuit comprising C10, D5 and R14 across the secondary winding of transformer T1.

The magnitude of the high voltage across capacitors C11 and C12 may also be regulated by ambient light conditions. Voltage divider resistors R15 and R6 are shunted by a light sensing circuit P1 and R7 to place resistance in parallel with R6 as ambient light increases in intensity. This has the effect of reducing the error voltage to integrated circuit Z2 for a given high voltage output, permitting the output high voltage to rise until the error signal is again zero. The increased high voltage available under increased ambient light conditions results in a greater strobe light output intensity.

Circuit connections to integrated circuit Z2 are completed by providing R1 and C1 which conventionally act in connection with an internal error amplifier of integrated circuit Z2.

The nominal input power for the strobe lighting system is 13.5 volts DC at 2.9 amperes. This input voltage is regulated down to 12 volts DC by three-terminal regulator integrated circuit Z1 for use as a supply voltage to various integrated circuits. Capacitor C14 is connected across regulator Z1 to assist output stability. Capacitor C13 is connected across the 13.5 volt DC input line to shunt external transients from the line to the strobe circuitry and from the strobe circuitry to the line. Diode D3 protects the strobe circuitry from an attempt to connect the system with an inverse polarity voltage which would produce a short circuit to open an external protective fuse. Zener diodes D1 and D2 protect against over-voltge at the primary power input of the power supply. Excess voltage applied to the input terminals will cause a breakdown of diode D1 and/or diode D2 which can be detected when trouble shooting the strobe light system.

FIG. 2 also shows a schematic embodiment of circuitry for controlling the flash tube discharge. Clock pulse output T from integrated circuit Z2 is applied to the base of transistor Q4 through resistor R16 to obtain an output pulse of about a 12 volt amplitude through resistor R17 in series with the collector of transistor Q4. The 12 volt output pulse is a compatible input to conventional integrated circuits of CMOS construction.

The 12 volt output pulse is connected to binary ripple counter Z3 and is supplied at the clock pulse output frequency, which is preferably 20,500 Hz. The input clock pulse is provided to pin 10 of counter Z3 and the output appears at pin 1. In a preferred embodiment, the input frequency of 20,500 Hz is divided by circuit Z3 to produce an output pulse frequency of 10 Hz.

The 10 Hz output pulse from counter Z3 forms an input pulse to decade counter Z4. Decade counter Z4 produces an output on 10 different output pins in sequence at each positive transition of the 10 Hz input pulse. Each output pin remains positive for a selected time, 100 milliseconds in a preferred embodiment. The output from pin 9 is connected to the counter reset at pin 15. Thus, the number of active output pins is 8, permitting a flash program sequence within an 800 millisecond time span.

The strobe light output sequence may be determined by a variety of external contraints, including regulations issued by government agencies for use in emergency vehicles, airplanes, off-shore signal devices, etc. One such specification requires two successive strobes at a 600 millisecond interval. This may be conveniently obtained from pins 1 and 6 of counter Z4.

Thus, a flash may occur on the leading edge of the output at pin 6. When pin 6 goes to a low state, pin 9 goes to a high state to reset counter Z4. In the output sequence of counter Z4, pin 1 transitions to a high state 500 milliseconds after the counter is reset to provide the desired 600 millisecond interval between the leading edge of the output on pin 6 and the leading edge of the output on pin 1. The leading edge of the output on pin 6 transitions to a high state 200 milliseconds after the pin 6 transitions to complete the strobe light sequence.

The strobe light timing sequence can be altered in 100 millisecond increments by hard wiring the desired output pins of counter Z4. Likewise, a single output flash may be selected.

The outputs from pins 1 and 6 of counter Z4 are provided to the base of transistor Q5 through diodes D10 and D9 respectively. Diodes D9 and D10 form an OR logic circuit to provide an output to transistor Q5 from either pin 1 or pin 6. Transistor Q5 produces a square wave output pulse. Resistor R21 serves as a pull down resistor to shorten the fall time for the output pulse.

This output pulse is provided to two differentiator networks. A first differentiator network is comprised of C16, R20 and the internal resistance of a solid state gate D8, which is conveniently depicted as an SCR. The output from a differentiated square wave pulse is a sharply defined pulse.

While energy storage capacitors C11 and C12 are charging toward the desired high voltage, trigger capacitor C15 is being charged through resistor R18. Zener diode D7 is provided to limit the voltage at capacitor C15, preferably to 200 volts. When the differentiated trigger pulse fires gate D8, capacitor C15 discharges rapidly through gate D8, producing current flow in the primary winding of transformer T2. Transformer T2 is a step up transformer mounted within flash tube unit V1 and it obtains the high voltage across the secondary winding which is required to fire the flash tube of unit V1. The flash tube of unit V1 may comprise a xenon flash tube to produce the desired light intensity.

When gate D8 fires, a small current and resulting voltage is developed across resistor R19 to extinguish gate D8 and terminate trigger current flow in the primary winding of T2 after tube firing is initiated. When tube firing is initiated by discharging capacitor C15, the energy stored in capacitors C11 and C12 is delivered to the ionized gases within the flash tube of unit V1 to produce a high intensity output light flash. Deionized gases require some time period to recombine in preparation for a subsequent discharge. This time period increases as the flash tube ages and the restoration might be prevented by even small voltages appearing across the gaseous tube of flash tube unit V1 before recombination is completed.

According to one feature of the present invention, timer circuit Z2 is disabled for a selected time after an output pulse is generated to inhibit the power generation output pulses. The second differentiation network connected to transistor Q5, capacitor C17 with resistors R23 and R24 and diode D11, provides the conventional differentiated square wave output having a high initial value which rapidly decreases. The differentiated output pulse S is applied to pin 10 of timer circuit Z2 and the output pulses on pin 14 are inhibited during the time inhibiting pulse S is above the voltage needed to inhibit timer circuit Z2.

As shown in FIG. 2, the differentiated pulse is above the effective shut down voltage for about 40 milliseconds. The 40 milliseconds shut down time stops power delivery to capacitors C11 and C12 and permits the flash tube to adequately recover before the application of any voltage across the gaseous tube. This delay permits a flash tube to be operated near the end of its useful operating life when conventional circuitry would require a replacement tube.

In one embodiment of the circuitry shown in FIG. 2, discrete circuit components are provided in Table A. The selection of discreet circuit components is considered within the capability of an ordinary circuit designer in view of the above description and Table A is merely exemplary.

TABLE A

| IC | Transistors | Diodes | Resistors (Ohms) | Capacitors (microfarads) |
|---|---|---|---|---|
| Z1 78L12CP | Q2 MPSA56 | D2 IN757 | R2 5.6K | C2 0.1 |
| Z2 SG 3524B | Q1 MPSA05 | D1 IN757 | R1 20K | C1 0.001 |
| Z3 4020 | Q3 IRFZ20 | D3 IN5404 | R3 5.6K | C3 0.01 (10%) |
| Z4 4017 | Q4 MPSA05 | D4 IN4007 | R4 3.3K | C4 0.001 |
| P1 VT-732 | Q5 MPSA05 | DS IN4007 | R5 10K | C5 0.0047 |
| | | D6 MR818 | R6 3.3K | C6 15 MF |
| | | D7 IN5281 | R7 12K | C7 0.0047 |
| | | D8 218 409 | R8 910 | C8 0.01 |
| | | D9 IN914 | R9 510 | C9 0.062 (100 v) |
| | | D10 IN914 | R10 360 | C10 0.002 (1 KV) |
| | | D11 IN914 | R11 51 | C11 290 MF |
| | | | R12 .03 (3%) | C12 290 MF |
| | | | R13 20 (2 W) | C13 2200 MF (25 V) |
| | | | R14 1M | C14 0.33 (35 V) |
| | | | R15 470K (½ W) | C15 0.05 (400 V) |
| | | | R16 12K | C16 0.01 (100 V) |
| | | | R17 18K | C17 33 MF |
| | | | R18 470K (½ W) | |
| | | | R19 1K | |
| | | | R20 150 | |
| | | | R21 56K | |
| | | | R22 12K | |
| | | | R23 39K | |
| | | | R24 10K | |

The pin numbers discussed in FIG. 2 are specific to the integrated circuits listed above.

It is therefore apparent that the present invention is one well adapted to attain all of the objects and advantages hereinabove set forth together with other advantages which will become obvious and inherent from a description of the product and operating procedure itself. It will be understood that certain combinations and subcombinations are of utility and may be obtained without reference to other features and subcombinations. This is contemplated by and is within the scope of the present invention.

We claim:

1. A circuit for firing a strobe light flash tube, comprising:

electronic clock means for generating a first output pulse train having a modulated pulse width and a second output pulse train having said modulated pulse width, a transformer having a primary winding and a secondary winding having an electrical energy output, an FET switch connected between said electronic clock means and said transformer, said FET receiving said first output pulse train and producing a rapidly changing input current in said primary winding, firing capacitor storage means connected between said secondary winding and said flash tube for storing said electrical energy output by said secondary winding, pulse counter means connected to said electronic clock means for receiving said second output pulse train, said pulse counter means producing control pulses at selected intervals, and control means connected between said pulse counter means and said flash tube to receive said control pulses, said control means providing trigger pulses to said flash tube to enable said stored electrical energy to discharge through said flash tube.

2. The circuit of claim 1, further comprising:

a resistive feedback circuit connected between said transformer and said electronic clock means for generating a modulation signal functionally related to said input current of said primary winding, and means connected between said feedback circuit and said electronic clock means for receiving said modulation signal and for modulating said first output pulse to a width effective to maintain said input current at a level less than a saturation current for said transformer.

3. The circuit of claim 1, further comprising:

transient damping circuits of resistor, capacitor and diode combinations connected across both said primary winding and said secondary winding to reduce self-induced transient voltages in said primary and secondary windings.

4. The circuit of claim 1, further including:

shutdown means connected between said control means and said electronic clock means and responsive to said control pulses for inhibiting generation of said first output pulse train for a selected interval after said discharge through said flash tube.

5. The circuit of claim 1, wherein said feedback circuit further includes:

a photocell circuit for regulating said stored electrical energy as a function of ambient lighting.

6. The circuit of claim 1, wherein said pulse counter means further includes:

a binary counter for producing pulses at an increased interval relative to said second output pulse train, and a decade counter connected to said binary counter, said decade counter having a plurality of selectable output states for deriving said control pulses from said increased interval pulses.

7. Strobe light firing circuit for triggering a flash tube, comprising:

electronic clock means for generating a first output pulse train having a modulated pulse width and a second output pulse train having said modulated pulse width, a transformer having a primary winding and a secondary winding having an electrical energy output, an FET switch connected between said electronic clock means and said transformer, said FET receiving said first output pulse train and producing a rapidly changing input current in said primary winding, firing capacitor storage means connected between said secondary winding and said flash tube for storing said electrical energy output by said secondary winding, a first counter connected to said electronic clock means for receiving said second output pulse train and for providing increased interval pulses functionally related to said second output pulse train, a second counter connected to said first counter for receiving said increased interval pulses, said second counter having a plurality of selectable output states for producing control pulses, and control means connected between said second counter and said flash tube to receive said control pulses, said control means providing trigger pulses to said flash tube to enable said stored electrical energy to discharge through said flash tube.

8. The firing circuit of claim 7, further including:

a resistive feedback circuit connected between said transformer and said electronic clock means for generating a modulation signal functionally related to said input current of said primary winding, and means connected between said feedback circuit and said electronic clock means for receiving said modulation signal and for modulating said first output pulse to a width effective to maintain said input current at a level less than a saturation current for said transformer.

9. The firing circuit of claim 7, further including:

transient damping circuits of resistor, capacitor and diode combinations connected across both said primary winding and said secondary winding to reduce self-induced transient voltages in said primary and secondary windings.

10. The firing circuit of claim 7, further including:

shutdown means connected between said control means and said electronic clock means and responsive to said control pulses for inhibiting generation of said first output pulse train for a selected interval after said discharge through said flash tube.

11. The firing circuit of claim 7, wherein said feedback circuit further includes:

a photocell circuit for regulating said stored electrical energy as a function of ambient lighting.

12. Strobe light firing circuit for triggering a flash tube, comprising:

electronic clock means for generating a first output pulse train having a modulated pulse width and a second output pulse train having said modulated pulse width, a transformer having a primary winding and a secondary winding having an electrical energy output, an FET switch connected between said electronic clock means and said transformer, said FET receiving said first output pulse train and producing a rapidly changing input current in said primary winding, firing capacitor storage means connected between said secondary winding and said flash tube for storing said electrical energy output by said secondary winding, a resistive feedback circuit connected between said transformer and said electronic clock means for generating a modulation signal functionally related to said input current of said primary winding, means connected between said feedback circuit and said electronic clock means for receiving said modulation signal and for modulating said first output pulse to a width effective to maintain said input current at a level less than a saturation current for said transformer, transient damping circuits of resistor, capacitor and diode combinations connected across both said primary winding and said secondary winding to reduce self-induced transient voltages in said primary and secondary windings, pulse counter means connected to said electronic clock means for receiving said second output pulse train, said pulse counter means producing control pulses at selected intervals, and control means connected between said pulse counter means and said flash tube to receive said control pulses, said control means providing trigger pulses to said flash tube to enable said stored electrical energy to discharge through said flash tube.

13. The firing circuit of claim 12, wherein said pulse counter means further includes:

a binary counter for producing pulses at an increased interval relative to said second output pulse train, and a decade counter connected to said binary counter, said decade counter having a plurality of selectable output states for deriving said control pulses from said increased interval pulses.

14. The firing circuit of claim 13, further including:

shutdown means connected between said control means and said electronic clock means and responsive to said control pulses for inhibiting generation of said first output pulse train for a selected interval after said discharge through said flash tube.

15. The firing circuit of claim 14, wherein said feedback circuit further includes:

a photocell circuit for regulating said stored electrical energy as a function of ambient lighting.

16. A method for triggering a flash tube in a strobe light system, including the steps of:

generating first and second output pulse trains having a selected pulse interval, deriving from said first pulse train a series of control pulses, passing a primary current through a primary winding of a transformer and an FET having a gate connected to receive said control pulses, switching said FET to a substantially nonconductive state to obtain a preselected rate of decrease of said primary current to induce a high transient voltage in a secondary winding of said transformer, applying said high voltage across firing capacitor storage means to store energy from said induced high transient voltage at an increasing average voltage to obtain a firing voltage for delivery to said flash tube, deriving from said second output pulse train a sequence of trigger pulses at predetermined intervals, and applying said trigger pulses to gate means for delivering said energy stored in said capacitor storage means to said flash tube.

17. A method according to claim 16, further including the step of:

modulating the width of pulses in said second output pulse train to maintain said primary current less than a saturation current for said primary winding.

18. A method according to claim 16, further including the steps of:

generating an error signal responsive to said increasing average voltage across said capacitor storage means, and generating said first output pulse train at a pulse amplitude functionally related to said error signal to maintain said predetermined firing voltage for delivery to said flash tube.

19. A method according to claim 16, wherein the step of deriving said trigger pulses comprises the steps of:

dividing said second pulse train to form a third output pulse train having a pulse interval substantially longer than said selected pulse interval for said second pulse train, inputting said third pulse train to a decade counter to form sequential signals on output terminals of said decade counter, and selecting signals from said output terminals to form said trigger pulses at said predetermined intervals.

20. A method according to claim 16, further including:

deriving a shutdown pulse in response to a said trigger pulse effective to terminate at least said first pulse train for a time effective for flash tube recovery.

21. A method according to claim 16, further including:

adjusting said firing voltage obtained across said capacitor storage means as a function of ambient light conditions.

22. A method for triggering a flash tube in a strobe light system, including the steps of:

generating first and second output pulse trains having a selected pulse interval, deriving from said first pulse train a series of control pulses, passing a primary current through a primary winding of a transformer and an FET having a gate connected to receive said control pulses, switching said FET to a substantially nonconductive state to obtain a preselected rate of decrease of said primary current to induce a high transient voltage in a secondary winding of said transformer, modulating the width of pulses in said second output pulse train to maintain said primary current less than a saturation current for said primary winding, applying said high voltage across firing capacitor storage means to store energy from said induced high transient voltage at an increasing average voltage to obtain a firing voltage for delivery to said flash tube, dividing said second pulse train to form a third output pulse train having a pulse interval substantially longer than said selected pulse interval for said second pulse train, inputting said third pulse train to a decade counter to form sequential signals on output terminals of said decade counter, combining signals from said output terminals to form a plurality of trigger pulses at predetermined intervals, and applying said trigger pulses to gate means for delivering said energy stored in said capacitor storage means to said flash tube.

23. The firing circuit of claim 22, further including:

generating an error signal responsive to said increasing average voltage across said capacitor storage means, and generating said first output pulse train at a pulse width functionally related to said error signal to maintain said predetermined firing voltage for delivery to said flash tube.

24. The firing circuit of claim 23, further including:

deriving a shutdown pulse in response to a said trigger pulse effective to terminate at least said first pulse train for a time effective for flash tube recovery.

25. The firing circuit of claim 24, further including:

adjusting said firing voltage obtained across said capacitor storage means as a function of ambient light conditions.

26. In a strobe light flashing system having a control circuit for delivering stored power to a flash tube at selected intervals, power generation and storage circuitry comprising:

electronic clock means for generating a first output pulse train having a modulated pulse width effective to controllably generate high voltage for application to said strobe light and a second output pulse train for use in deriving a control pulse effective to deliver said stored power for flashing said strobe light, a transformer having a primary winding for receiving an input current and a secondary winding having an output voltage related to the rate of change of said input current in said primary winding, an FET switch controlled by said first output pulse train for rapidly reducing said input current in said primary winding, and firing capacitor storage means connected across said secondary winding for storing electrical energy produced by said secondary winding when said FET reduces said current in said primary winding.

27. The circuit of claim 26, further including:

a resistive circuit for generating a modulation signal functionally related to said input current of said primary winding, and means responsive to said modulation signal for modulating said first output pulse to a width effective to maintain said input current at a level less than a saturation current for said transformer.

28. The circuit of claim 27, further including:

transient damping circuits of resistor, capacitor and diode combinations across said primary winding and said secondary winding to reduce self-induced transient voltages in said primary and secondary windings.

29. In a strobe light flashing system having an energy generation and storage system for storing energy at a voltage effective to discharge a flash tube, a circuit for controlling delivery of said stored energy to said flash tube, comprising:

electronic clock means for generating a first output pulse train having a modulated pulse width effective to generate said energy for storage and a second output pulse train for use in deriving a control pulse effective to deliver said energy to said flash tube, pulse counter means connected to said electronic clock means for receiving said second output pulse train, said pulse counter means producing control pulses at selected intervals, and control means connected between said pulse counter means and said flash tube to receive said control pulses, said control means providing trigger pulses to said flash tube to enable said stored electrical energy to discharge through said flash tube.

30. The circuit of claim 29, further including:

shutdown means connected between said control means and said electronic clock means and responsive to said control pulses for inhibiting generation of said first output pulse train for a selected interval after said discharge of energy through said flash tube.

31. The circuit of claim 29, wherein said feedback circuit further includes:

a photocell circuit for regulating said stored energy delivered to said flash tube as a function of ambient lighting.

32. The circuit of claim 29, wherein said pulse counter means further includes:

a first counter connected to said electronic clock means for receiving said second output pulse train and for providing pulses at an increased interval relative to said second output pulse train, and a second counter connected to said first counter for receiving said increased interval pulses, said second counter having a plurality of selectable output states for producing said control pulses.

* * * * *